US008688005B2

(12) United States Patent
Nozawa

(10) Patent No.: US 8,688,005 B2
(45) Date of Patent: Apr. 1, 2014

(54) FIXING DEVICE, METHOD OF INSTALLING SAME, AND IMAGE FORMING APPARATUS

(75) Inventor: Kenji Nozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 204 days.

(21) Appl. No.: 13/193,171

(22) Filed: Jul. 28, 2011

(65) Prior Publication Data

US 2012/0027462 A1 Feb. 2, 2012

(30) Foreign Application Priority Data

Jul. 29, 2010 (JP) ..... 2010-170054

(51) Int. Cl.
*G03G 21/18* (2006.01)

(52) U.S. Cl.
USPC ..... 399/122; 399/107; 399/110; 399/320

(58) Field of Classification Search
USPC ..... 399/122, 107, 110, 320
See application file for complete search history.

(56) References Cited

U.S. PATENT DOCUMENTS

| | | | | |
|---|---|---|---|---|
| 2006/0140675 | A1* | 6/2006 | Kim et al. | 399/122 |
| 2011/0052258 | A1* | 3/2011 | Kamoshida et al. | 399/122 |

FOREIGN PATENT DOCUMENTS

| | | | |
|---|---|---|---|
| CN | 1740920 | A | 3/2006 |
| CN | 201000546 | Y | 1/2008 |
| JP | 63-045556 | | 3/1988 |
| JP | 03-110460 | | 11/1991 |
| JP | 09-080943 | | 3/1997 |
| JP | 2001-100576 | | 4/2001 |
| JP | 2001-206562 | | 7/2001 |
| JP | 2006-003714 | | 1/2006 |
| JP | 2006-162997 | | 6/2006 |
| JP | 2009-271175 | | 11/2009 |
| JP | 2009-271178 | | 11/2009 |

OTHER PUBLICATIONS

Office Action and Search Report issued Oct. 10, 2013 in Chinese Patent Application No. 201110219522.7.
Office Action issued Jan. 7, 2014, in Japanese Patent Application No. 2010-170054, filed Jul. 29, 2010.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A fixing device includes an enclosure housing, a removable handle, and a detachable attachment mechanism. The enclosure housing encloses the fixing device therein. The removable handle detachably attaches to the housing to move the housing at least in a direction of handling. The detachable attachment mechanism includes a pair of first mutually engageable portions in the housing and a pair of second mutually engageable portions in the handle. A method of installing a fixing device in an image forming apparatus is also disclosed.

19 Claims, 5 Drawing Sheets

FIXING DEVICE, METHOD OF INSTALLING SAME, AND IMAGE FORMING APPARATUS

CROSS-REFERENCE TO RELATED APPLICATIONS

The present patent application claims priority pursuant to 35 U.S.C. §119 from Japanese Patent Application No. 2010-170054, filed on Jul. 29, 2010, which is hereby incorporated by reference herein in its entirety.

BACKGROUND OF THE INVENTION

1. Field of the Invention

Exemplary aspects of the present invention relate to a fixing device and a method of installing the same, and more particularly, to a fixing device that fixes a toner image in place on a recording medium with heat and pressure, and a method of installing such a fixing device in an image forming apparatus, such as a photocopier, facsimile machine, printer, plotter, or multifunctional machine incorporating several of those imaging functions.

2. Description of the Background Art

In electrophotographic image forming apparatuses, such as photocopiers, facsimile machines, printers, plotters, or multifunctional machines incorporating several of those imaging functions, an image is formed by attracting toner particles onto a photoconductive surface for subsequent transfer to a recording medium such as a sheet of paper. After transfer, the imaging process is often followed by a fixing process using a fixing device, which permanently fixes the toner image in place on the recording medium by melting and settling the toner with heat and pressure.

A fixing device may involve various pieces of mechanical equipment, such as a motor-driven rotary belt and roller assembly with heat and pressure sources provided therein, some of which require regular replacement, and others may need occasional repair or adjustment for correcting paper jams and other operational failures. To facilitate maintenance of such components, a fixing device could employ a unitized, integral enclosure in which the entire assembly is integrated into a single integrated unit for installation in an image forming apparatus incorporating the fixing capability.

SUMMARY OF THE INVENTION

Exemplary aspects of the present invention are put forward in view of the above-described circumstances, and provide a novel fixing device installable in an image forming apparatus.

In one exemplary embodiment, the novel fixing device includes an enclosure housing, a removable handle, and a detachable attachment mechanism. The enclosure housing encloses the fixing device therein. The removable handle detachably attaches to the housing to move the housing at least in a direction of handling. The detachable attachment mechanism includes a pair of first mutually engageable portions in the housing and a pair of second mutually engageable portions in the handle.

Other exemplary aspects of the present invention are put forward in view of the above-described circumstances, and provide a novel method of installing a fixing device in an image forming apparatus.

In one exemplary embodiment, the fixing device includes an enclosure housing and a removable handle that detachably attaches to the housing. The method includes the steps of enclosure, attachment, mounting, and detachment. The enclosure step encloses the fixing device in the housing. The attachment step attaches the handle to the housing. The mounting step mounts the housing onto the image forming apparatus with the attached handle. The detachment step detaches the handle from the housing mounted on the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
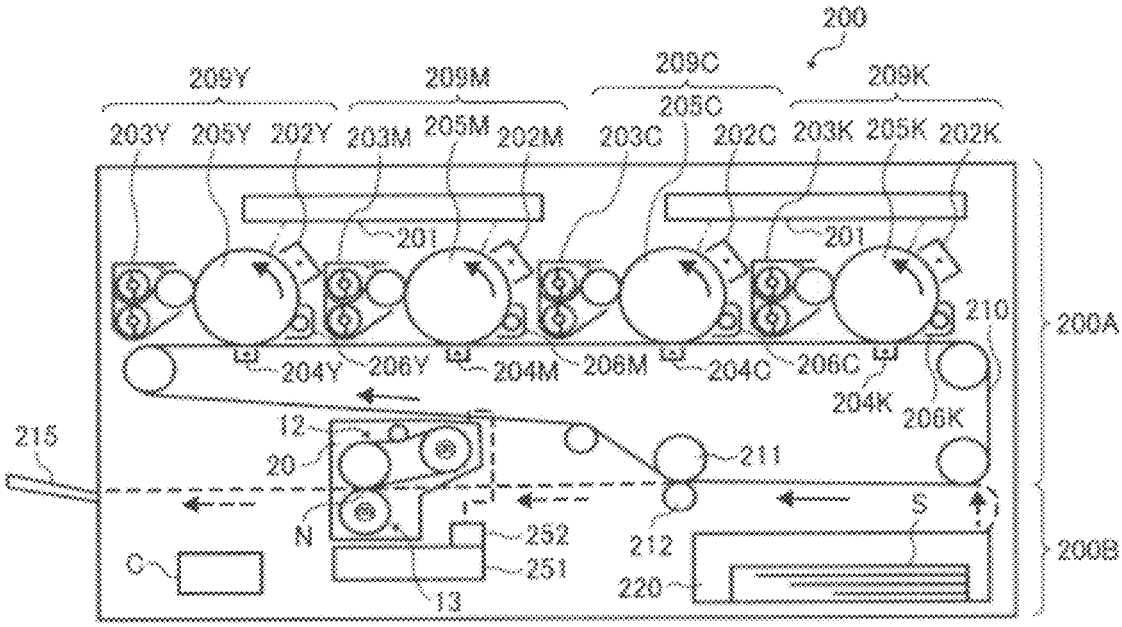
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 200 incorporating a fixing device 20 according to one embodiment of this patent specification.

As shown in FIG. 1, the image forming apparatus 200 is a high-speed, digital color imaging system that can print a color image on a recording medium such as a sheet of paper S according to image data, consisting of an upper, printer section 200A, and a lower, sheet feeding section 200B combined together to form a freestanding unit, on top of which may be deployed an appropriate image scanner, not shown, that allows for capturing image data from an original document.

The printer section 200A comprises a tandem color printer that forms a color image by combining images of yellow, magenta, and cyan (i.e., the complements of three subtractive primary colors) as well as black, consisting of four electrophotographic imaging stations 209Y, 209M, 209C, and 209K arranged in series substantially laterally along the length of an intermediate transfer belt 210, each forming an image with toner particles of a particular primary color, as designated by the suffixes "Y" for yellow, "M" for magenta, "C" for cyan, and "K" for black.

Each imaging station 209 includes a drum-shaped photoconductor 205 rotatable counterclockwise in the drawing, surrounded by various pieces of imaging equipment, such as a charging device 202, a scanning device 201, a development device 203 accommodating toner of the associated primary color, an electrically biased, primary transfer device 204, a cleaning device 206 for the photoconductive surface, etc., which work in cooperation to form a primary toner image on the photoconductor 205 for subsequent transfer to the intermediate transfer belt 210 at a primary transfer gap defined between the photoconductive drum 205 and the primary transfer device 204.

The intermediate transfer belt 210 is trained around a motor-driven roller and other support rollers to rotate clockwise in the drawing, passing through the four primary transfer gaps sequentially to carry thereon a multi-color toner image toward a secondary transfer nip defined between a secondary transfer roller 212 and a backup roller 211, at which the toner image is transferred to a recording sheet S fed from the sheet feeding section 200B.

The sheet feeding section 200B includes a sheet tray 220 accommodating a stock of recording sheets S, as well as a sheet conveyance mechanism, including multiple rollers, guide plates, etc., which together define a sheet conveyance path for conveying a recording sheet S from the sheet tray 220 to the secondary transfer nip, then through the fixing device 20, and then into an output sheet stacker 215 disposed outside the apparatus body to accommodate a finalized print for user pickup. In the present embodiment, the sheet conveyance path is generally horizontal where it extends from the secondary transfer nip to the fixing device 20.

The fixing device 20 includes a pair of rotary fixing members 12 and 13, at least one of which is heated and at least one of which is pressed against the other to form a fixing nip N therebetween through which the recording sheet S is passed to fix the toner image in place on with heat and pressure. Below the fixing device 20 is an oil tank 251 accommodating a release agent or oil for application to the rotary fixing members to promote ready separation of recording media therefrom, connected to the fixing device 20 via a suitable circulator such as a pump 252 through which the release agent circulates between the tank 251 and the fixing device 20 for supply and recovery.

During operation, each imaging station 209 rotates the photoconductor drum 205 counterclockwise in the drawing to forward its outer, photoconductive surface to a series of electrophotographic processes, including charging, exposure, development, transfer, and cleaning, in one rotation of the photoconductor drum 205.

First, the photoconductive surface is uniformly charged by the charging device 202 and subsequently exposed to a modulated laser beam emitted from the scanning device 201. The laser exposure selectively dissipates the charge on the photoconductive surface to form an electrostatic latent image thereon according to image data representing a particular primary color. Then, the latent image enters the development device 203 which renders the incoming image visible using toner. The toner image thus obtained is forwarded to the primary transfer device 204 that electrostatically transfers the primary toner image to the intermediate transfer belt 210 through the primary transfer gap.

As the multiple imaging stations 209 sequentially produce toner images of different colors at the four transfer gaps along the belt travel path, the primary toner images are superimposed one atop another to form a single multicolor image on the moving surface of the intermediate transfer belt 210 for subsequent entry to the secondary transfer nip defined between the secondary transfer roller 212 and the backup roller 211.

Meanwhile, the sheet conveyance mechanism picks up a recording sheet S from atop the sheet stack in the sheet tray 220 to advance it in sync with the movement of the intermediate transfer belt 210 to the secondary transfer nip. At the secondary transfer nip, the multicolor image is transferred from the belt 210 to the recording sheet S, which is then introduced into the fixing device 20 to fix the toner image in place under heat and pressure at the fixing nip N defined between the fuser belt 12 and the pressure roller 13.

Upon completion of printing, the recording sheet S proceeds along the conveyance path to the sheet stacker 215 outside the apparatus body for user pickup, which completes one operational cycle of the image forming apparatus 200.

Figure 2:
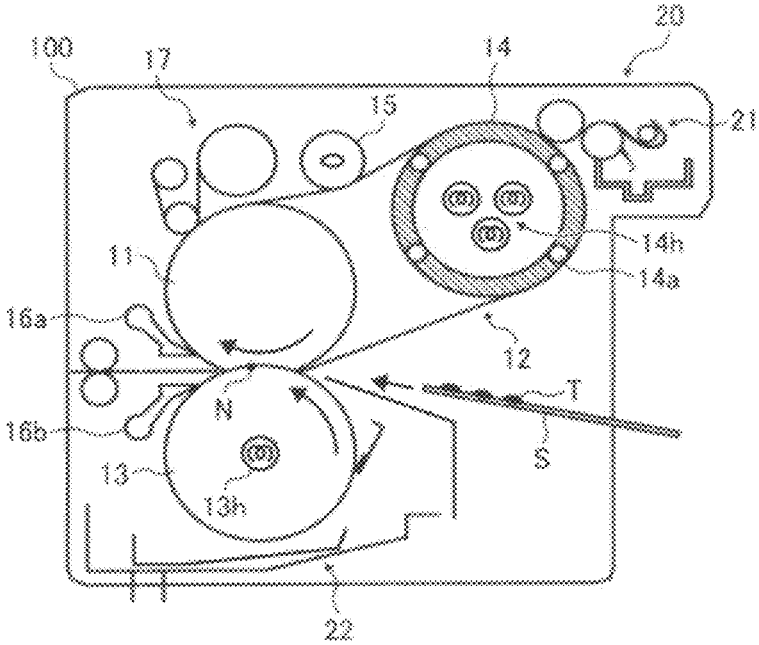
FIG. 2 is an end-on, axial cutaway view schematically illustrating the fixing device incorporated in the image forming apparatus of FIG. 1.

FIG. 2 is an end-on, axial cutaway view schematically illustrating the fixing device 20 incorporated in the image forming apparatus 200.

As shown in FIG. 2, the fixing device 20 includes a rotary fuser belt 12 looped for rotation around a fuser roller 11 and a heat roller 14, and a rotary pressure roller 13 pressed against the fuser roller 11 through the fuser belt 12 to form a fixing nip N therebetween.

Also included in the fixing device 20 are a tension roller 15, disposed against the fuser belt 12 to maintain a proper tension on the looped belt 12, and a belt cleaner 17, disposed against the fuser belt 12 to clean the belt surface of residual toner. A pair of sheet strippers 16*a* and 16*b*, one facing the fuser belt 12 and the other facing the pressure roller 13, are disposed to separate a recording sheet S from the associated rotary member. Further, a pair of first and second oil applicators 21 and 22, the former for the fuser belt 12 and the latter for the pressure roller 13, are provided to apply a release agent or oil to the rotary fixing members.

During operation, the pressure roller 13 rotates counterclockwise in the drawing to rotate the fixing roller 11 clockwise in the drawing, which in turn rotates the fuser belt 12 in the same rotational direction. The fuser belt 12 during rotation is kept in proper tension with the tension roller 15 pressing against the belt 12 from outside of the belt loop, while having its circumference heated with the heat roller 14 to a given processing temperature sufficient for fusing toner at the fixing nip N.

In this state, a recording sheet S bearing an unfixed, powder toner image T enters the fixing device 20, with its printed side facing the fuser belt 12. As the rotary fixing members 12 and 13 rotate together, the recording sheet S is passed through the fixing nip N to fix the toner image in place, wherein heat from the fuser belt 12 causes toner particles to fuse and melt, while pressure from the pressure roller 13 causes the molten toner to settle onto the sheet surface.

At the exit of the fixing nip N, the sheet strippers 16*a* and 16*b*, with their longitudinal edges engageable with the leading edge of the outgoing sheet S, serve to strip the sheet S off the associated rotary members, each of which has its circumferential surfaces supplied with release agent before entering the fixing nip N. Provision of the sheet strippers 16*a* and 16*b* and the oil applicators 21 and 22 protects the fixing device 20 from sheet conveyance failure, which would arise where a recording sheet having a toner image fixed thereupon adheres and wraps around the rotary fixing members as it exits the fixing nip. The recording sheet S thus properly exiting the fixing nip N proceeds to outside the fixing device 20 along the sheet conveyance path.

In the present embodiment, the fuser belt 12 comprises an endless, multilayered belt formed of a substrate of stiff material upon which is deposited at least an outer layer of elastic material. For example, the fuser belt 12 may be a bi-layered belt consisting of a substrate of nickel, stainless steel, or polyimide, coated with an elastic layer of silicone rubber deposited thereupon.

The fuser roller 11 comprises a metal-cored rubber roller, approximately 50 mm or greater in diameter and approximately 300 mm or longer in length, consisting of a cylindrical core of metal covered by an elastic layer of silicone rubber or the like deposited thereupon. To reduce warm-up time, sponged silicone rubber may be used to form the outer elastic layer, which does not absorb excessive heat to cause conductive heat loss where the rubber roller 11 contacts the fuser belt 12.

The heat roller 14 comprises a hollow roller of thermally conductive metal, such as iron or aluminum, approximately 50 mm or greater in diameter and approximately 300 mm or longer in length, which accommodates a radiant halogen heater 14*h* or the like in its hollow interior to supply heat to the fuser assembly. Another heating mechanism, such as an electromagnetic induction heater (IH), may also be employed instead of a radiant heater. Operation of the heater 14*h* may be controlled according to readings of a thermometer or thermistor disposed adjacent to the heat roller 14 to detect temperature of the fuser belt 12.

Optionally, the heat roller 14 may have a set of multiple thin, hollow heat pipes 14*a* disposed radially and symmetrical with respect to its rotational axis, each encompassing the entire roller length and embedded in the wall of the metal roller. Provision of the heat pipes 14*a* to the heat roller 14 promotes transfer of heat from inside to outside the roller circumference, which allows for rapid and uniform heating of the fuser belt 12 rotating around the heated roller 14.

The pressure roller 13 comprises a motor-driven, metal-cored rubber roller consisting of a hollow rotatable core of metal, such as iron, aluminum, or the like, covered by an elastic layer of silicone rubber or the like deposited thereupon, provided with a biasing mechanism that presses the pressure roller 13 against the fixing roller 11 with a regulated constant pressure. An optional, dedicated heater 13*h* may be provided in the hollow interior of the pressure roller 13, so as to heat the pressure roller 13 to a desired temperature during fixing or where required.

The pair of sheet strippers 16*a* and 16*b* are sharp-edged, elongated pieces of appropriate material disposed opposed to each other downstream from the fixing nip N along the sheet conveyance path, with their free, operational edges adjoining the fuser belt 12 and the pressure roller 13, respectively, so as to allow a recording sheet S to separate from the associated rotary member at the exit of the fixing nip N.

The belt cleaner 17 comprises a web of appropriate material entrained about pulleys while held against the rotating belt 12 to remove or wipe off residual toner and other adherents from the belt surface.

The first and second oil applicators 21 and 22 may be any suitable mechanism for applying oil or release agent to the associated rotary member to promote ready separation of recording media. Release agents usable in the fixing device 20 include silicone oil or any other suitable heat-resistant, non-volatile oil, which may be supplied from the external oil tank 251 through the circulator pump 252 provided in the image forming apparatus 200.

In addition, although the fixing assembly depicted above includes an endless fuser belt paired with a pressure roller, the fixing device 20 according to this patent specification may be configured otherwise than as specifically disclosed herein. For example, the rotary fuser member may be any rotatable mechanism with its circumference subjected to heating, such as a hollow cylindrical roller provided with a suitable heat source. The rotary pressure member may be any rotatable mechanism subjected to pressure against the fuser member, such as an endless belt entrained around multiple support rollers one of which is pressed against the fuser member through the entrained belt.

Components of the fixing device 20 recited above may be integrated into a single integrated unit accommodated in an enclosure housing 100 for installation in the image forming apparatus 200. The housing 100 is sufficiently durable to support the entire weight of the fixing assembly, including the two metal-based fixing rollers 11 and 14 which by themselves can weigh approximately several to several dozen kilograms in total. In the present embodiment, the total weight of the rollers 11 and 14 amounts to approximately 10 kilograms, where each fixing roller is approximately 80 mm in diameter and approximately 400 mm in length.

Figure 3:
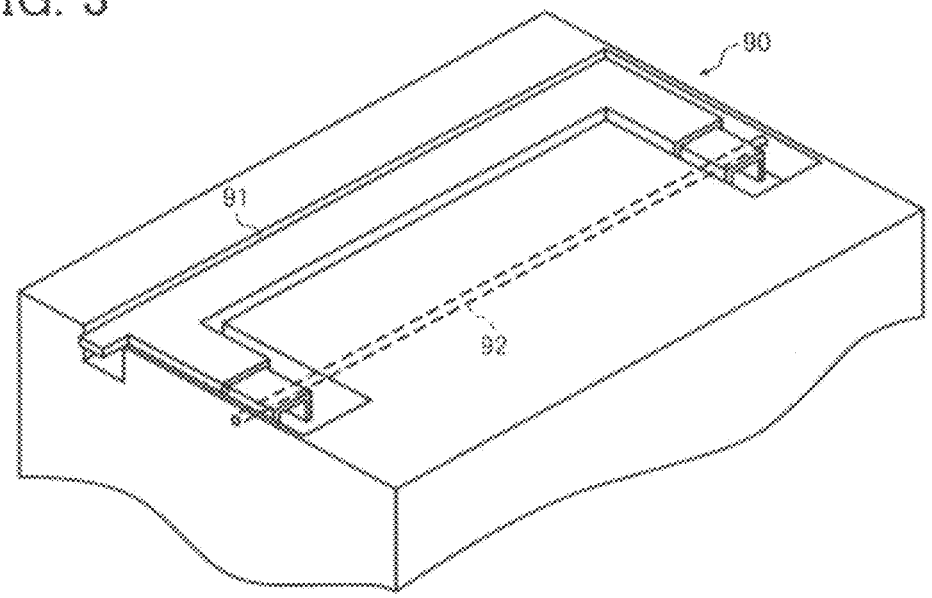
FIG. 3 is a partial perspective view schematically illustrating a related art enclosure housing for enclosing a fixing device.

FIG. 3 is a partial perspective view schematically illustrating a related art enclosure housing 90 for enclosing a fixing device.

As shown in FIG. 3, the enclosure housing 90 comprises a generally rectangular portable container to which is secured a hinged, foldaway built-in handle 91 pivotable around an elongated shaft 92. When not in use, the built-in handle 90 folds in a horizontal position within a generally U-shaped recess defined in the top side of the housing 90. The handle 91 is usable when swiveled around the shaft 92 upward away from the folded position into an upright, operative position.

To maintain the fixing device installed in an image forming apparatus, a user sets the handle 91 into the upright position, lifts or carries the housing 90 by the handle 91, and moves the housing 90 to the outside where he or she can perform a needed maintenance operation on the fixing device. After completion of maintenance, the user again lifts or carries the housing 90 by the handle 91, mounts the housing 90 onto the image forming apparatus, and folds the handle 91 into the horizontal position for accommodation inside the apparatus body.

One problem associated with the enclosure housing 90 is that its built-in foldaway handle 91 becomes too hot to grip by hand during operation of the fixing device which involves radiation of heat with an internal heat source, making it difficult for a user to service the fixing device immediately after operation. This is particularly true in today's high-speed, high-yield printers where thermal fixing of toner is accelerated by applying increased amounts of heat to the toner image.

To address the problem, one possible approach is to provide thermal insulation, such as an air gap or an adhesive sheet of insulating material, around the built-in handle to prevent heat conduction from the surrounding structure. Another approach is to take some protective measures against heat when handling the fixing device immediately after operation, for example, wearing protective gloves, or taking sufficient time to allow the handle to cool by dissipating accumulated heat to the air.

Unfortunately, however, these approaches are impractical or insufficient to provide a cost-effective, user-serviceable fixing device. That is, providing thermal insulation requires a substantial amount of material or space in the fixing device to keep the built-in handle sufficiently cool during operation, which would significantly add to the cost and size of the image forming apparatus. On the other hand, the protective measure approach is not satisfactory, for it is up to each user to take sufficient caution to avoid contact with the heated handle in handling the fixing device.

Hence, in practice, manufacturers of image forming apparatus may limit access to the fixing device only to service technicians, who are trained to service the image forming apparatus safely.

In contrast to the related art enclosure housing 90, the enclosure housing 100 according to this patent specification is provided with a detachably attached, removable handle that can temporary connect to the housing 100 to enable handling of the housing 100, and separate from the housing 100 where such connection is no longer necessary. Embodiments of the enclosure housing 100 with such removable handle are now described in detail with reference to FIGS. 4A and 4B and subsequent drawings.

Figure 4A:
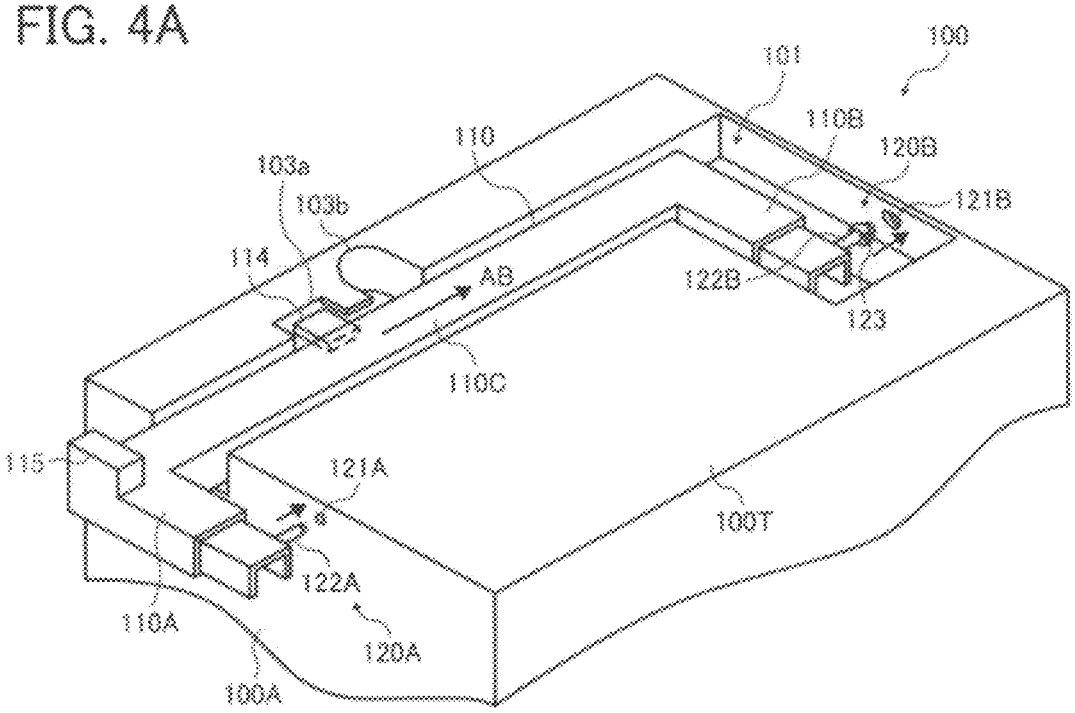
FIGS. 4A and 4B are partial perspective views schematically illustrating an enclosure housing for enclosing the fixing device according to one embodiment of this patent specification, with a removable handle being detached and attached, respectively, to the housing.
Figure 4B:
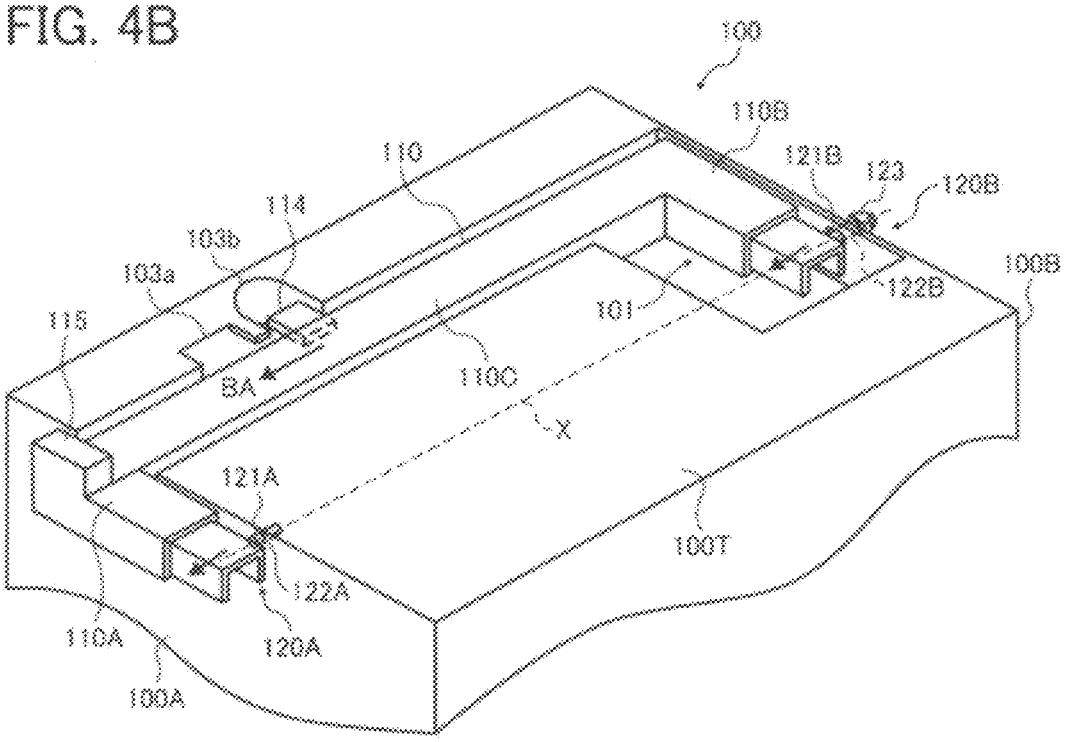

FIGS. 4A and 4B are partial perspective views schematically illustrating the enclosure housing 100 according to one embodiment of this patent specification, with its removable handle 110 being detached and attached, respectively, to the housing 100.

As shown in FIGS. 4A and 4B, the enclosure housing 100 in the present embodiment comprises a generally rectangular container to enclose the fixing device 20 therein. The removable handle 110 is detachably attached to the housing 100 to allow a user to move the housing 100 by forcing the handle 110 at least in a direction of handling, e.g., a vertical direction perpendicular to the plane on which the container is mounted. The term "direction of handling" as used herein refers to a direction in which the housing 100 is moveable by the handle 110, including not only the vertical direction as in the present embodiment, but also a horizontal direction perpendicular to the vertical direction, or any direction oblique to the vertical and horizontal directions as set forth herein.

Specifically, the housing 100 consists of a pair of top and bottom horizontal walls and four vertical sidewalls extending perpendicular to the horizontal walls to together define a space enclosing the fixing assembly therein, of which only a top wall 100T and one pair of opposed, first and second sidewalls 100A and 100B are specifically shown and designated in the drawings. Where the housing 100 is designed to enter the image forming apparatus 200 by horizontal movement during installation, the first sidewall 100A defines a first, front side that faces forward into the apparatus body, and the second sidewall 100B defines a second, rear side that faces rearward opposite the apparatus body.

Figure 5:
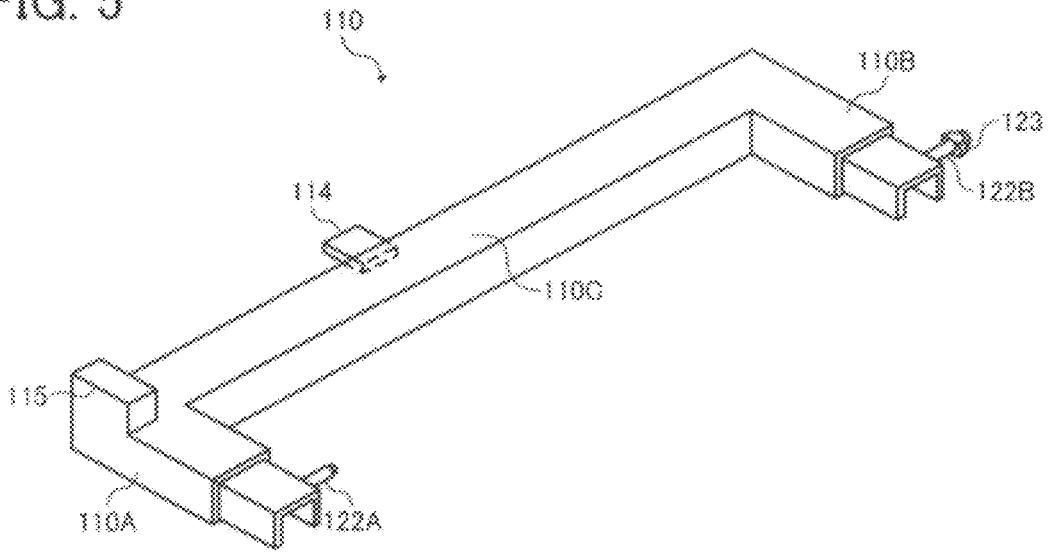
FIG. 5 is a perspective view of the removable handle in isolation from the enclosure housing of FIGS. 4A and 4B.

With additional reference to FIG. 5, which is a perspective view of the removable handle 110 in isolation from the enclosure housing 100, the removable handle 110 is shown shaped in a generally U-shaped configuration having an elongated, grippable body or grip 110C extending in a longitudinal direction thereof, with a pair of first and second parallel side arms 110A and 110B extending perpendicular to the grip 110C from opposed longitudinal ends thereof.

For attachment to the housing 100, the handle 110 is placed with the grip 110C extending horizontally on the housing top wall 100T, and the parallel side arms 110A and 110B adjoining the housing sidewalls 100A and 100B. A generally L-shaped recess 101 may be defined in the top wall 100T of the housing 100 to place the handle 110 therein, consisting of a longer section to accommodate the elongated body 110C and a shorter section to accommodate the second side arm 110B and the associated structure of the U-shaped handle 110. The longer section of the recess 101 is dimensioned to snugly fit the width of the grip 110C to allow the handle 110 to slide in the horizontal, longitudinal direction upon placement on the recessed recess 101 of the housing 100.

According to this patent specification, the removable handle 110 is connected to the enclosure housing 110 via a detachable attachment mechanism 120 formed of a pair of first and second, mutually engageable portions 121 and 122, the former disposed at the housing 100 and the latter at the handle 110, which can detachably attach the handle 110 to the housing 100 when engaged with each other.

With specific reference to FIGS. 4A and 4B, the detachable attachment mechanism 120 in the present embodiment is shown including a first engageable portion or slot 121 defined in each sidewall of the housing 100 adjoining the side arm of the handle 110, and a second engageable portion or pin 122 provided at each side arm of the handle 110 for insertion into the adjoining slot 121. When inserted into the corresponding slot 121, each pin 122 extends horizontally, i.e., in a direction perpendicular to the vertical direction in which the handle 110 is forced during handling, so as to remain in position within the slot 121 as the housing 100 is moved in the direction of handling by using the handle 110.

Specifically, the slot 1213 on the second side is positioned where the sidewall 100B faces the shorter section of the L-shaped recess 101, and the slot 121A on the first side is substantially coaxial with, or aligned vertically and horizontally with, the opposed slot 121B thus positioned. The pins 122A and 122B are disposed substantially coaxial with, or aligned vertically and horizontally with, each other, both pointing in a uniform, horizontal direction parallel to the longitudinal direction of the handle grip 110C.

In such a configuration, the detachable attachment mechanism 120 is engaged and disengaged by a single longitudinal sliding motion of the handle 110 along the recessed wall 101 of the housing 100, as shown in FIGS. 4A and 4B. That is, the coaxial pins 122A and 122B enter the respective slots 121A and 121B simultaneously where the handle 110 slides in a rearward direction from the first side to the second side within the recess 101 (as indicated by arrow AB in FIG. 4A). Contrarily, the coaxial pins 122A and 102B of the handle 110 exit the respective slots 121A and 121B of the housing 100 simultaneously where the handle 110 slides in a forward direction from the second side to the first side within the recess 101 (as indicated by arrow BA in FIG. 4B).

Further, the pins 122A and 122B inserted into the respective slots 121A and 121B together define a pivot axis X around which the removable handle 110 is rotatable, as shown in FIG. 4B. With additional reference to FIG. 6, the removable handle 110 is shown swiveled around the axis X upward into an operative position approximately 90 degrees from the horizontal position. With the handle 110 in this upright position, a user can move, lift, or carry the housing 100 by using the handle 110 attached thereto.

With further reference to FIGS. 4A and 4B, the handle 110 is shown with a positioning tab 114 extending from the grip 110C in a protruding direction opposite that of the handle arms 110A and 110B, slightly offset from midway between the opposed longitudinal ends of the elongated grip 110C. A pair of adjacent first and second positioning notches 103*a* and 103*b*, the latter slightly larger than the former, is disposed on the top wall 110T of the housing 100, branching off from the longer section of the L-shaped recess 101, and superficially partitioned into two compartments that communicate with each other under the partition wall.

The positioning tab 114 is designed for alignment with the positioning notches 103*a* and 103*b* to properly position the handle 110 slid in the horizontal direction during attachment to the housing 100. The positioning tab 114 also serves as an operating tab that allows ready manipulation of the handle 110 swiveled around the pivot axis X. For good operability of the operating tab 114, the second notch 103*b*, which is slightly larger than the first notch 103*a*, is dimensioned larger than the tab 114, so that a user can readily pick up the tab 114 from within the second notch 103*b* when manipulating the handle 110.

Optionally, a retention head 123 may be disposed around at least one of the pins 122 to prevent disengagement of the detachable attachment mechanism 120 where the removable handle 110 is in the operative position.

In the present embodiment, the retention head 123 is configured as a radially asymmetrical annular flange fitted around the pin 122B. The flange 123 may have a D-shaped cross-section larger than a substantially circular cross-section of the pin shank, in which case the slot 121B is shaped in a D-shaped configuration similar to that of the retention flange 123.

Where the handle 110 is in the horizontal mounting position, the flange 123 matches or aligns with the slot 121B to allow insertion of the flanged pin 122B into the slot 121B by sliding the handle 110 in the longitudinal direction. Once the pin 122B with its flange 123 enters the corresponding slot 121B, rotating the handle 110 around the axis X causes a skew or misalignment between the D-shaped profiles of the flange 123 and the slot 121B.

Thus, where the handle 110 is in the upright operative position, the flange 123 prevents removal of the flanged pin 122B from the slot 121B as the handle 110 is forced in the longitudinal direction. Such retention mechanism effectively prevents the removable handle 110 from inadvertently disengaging from the housing 100 during handling, thereby enabling a user to safely move, lift, or carry the housing 100 by using the handle 110.

Further, to provide good stability during carriage of the housing 100, the detachable attachment mechanism 120 (or the pair of coaxial slots 121) may be positioned vertically upward from a center of gravity of the enclosure housing 100 enclosing the fixing device.

Such positioning of the detachable attachment mechanism 120 allows a user to lift and carry the housing 100 in a stable horizontal position using the handle 110, thereby preventing any damage to the fixing assembly caused during carriage of the enclosure housing.

Hence, the detachable attachment mechanism 120 according to this patent specification provides stable temporary connection of the removable handle 110 to the enclosure housing 100 without involving special tools, wherein a user can readily attach the handle 110 to the housing 100 by simply sliding the handle 110 along the housing 100 to insert the pins 122 into the slots 121, and readily detach the handle 110 from the housing 100 by simply sliding the handle 110 along the housing 100 to remove the pins 122 from the slots 121.

To attach the removable handle 110 to the enclosure housing 100, a user initially places the handle 110 on the top wall 100T of the housing 100 with the positioning tab 114 aligned with the first notch 103*a* to establish a first mounting position, as shown in FIG. 4A. In this position, the handle 110 lies horizontally in the L-shaped recess 101 with the engageable pins 122 aligned with, but not engaging, the corresponding slots 121 of the sidewalls of the housing 100.

Then, the user slides the handle 110 in the rearward longitudinal direction AB along the length of the elongated grip 110C from the first side to the second side until the positioning tab 114 aligns with the second notch 103*b* to establish a second mounting position, as shown in FIG. 4B. In this position, the handle 110 lies horizontally in the L-shaped recess 101 with the engageable pins 122 entering the corresponding slots 121 of the sidewalls of the housing 100.

Figure 6:
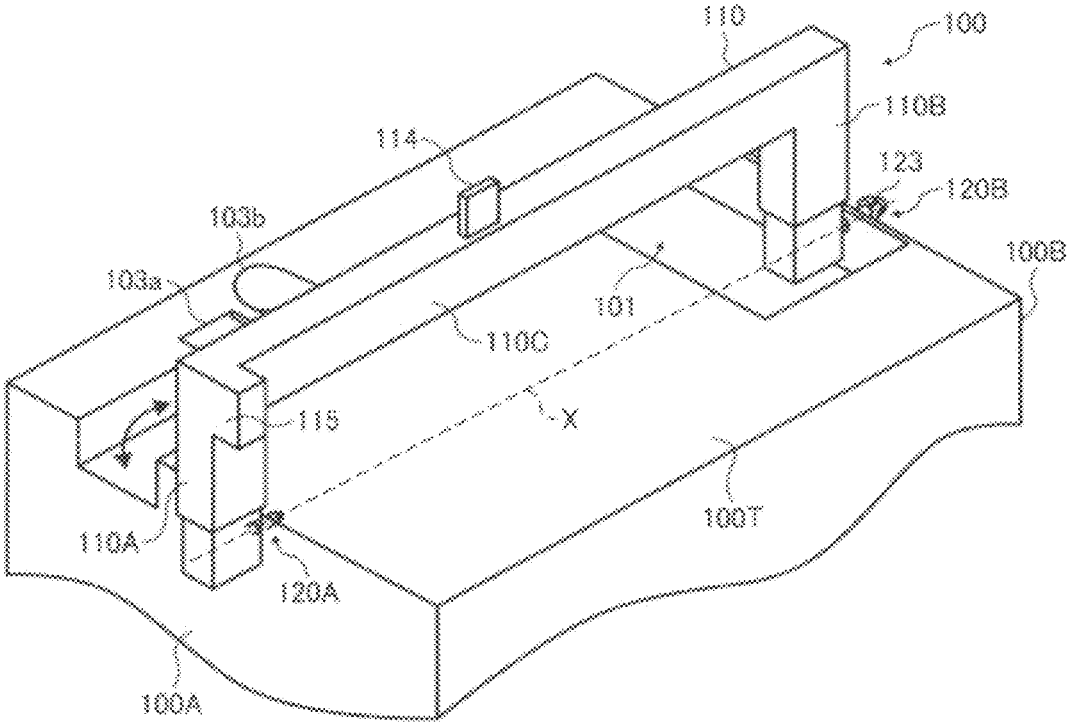
FIG. 6 is a partial perspective views schematically illustrating the enclosure housing of FIGS. 4A and 4B, with the removable handle swiveled into an operative position.

The engageable pins 122A and 122B thus inserted into the respective slots 121A and 121B together define the pivot axis X extending in the longitudinal direction around which the handle 110 is rotatable. The user swivels the handle 110 around the pivot axis X into an upright operative position approximately 90 degrees away from the second mounting position by pulling up the positioning tab 114, as shown in FIG. 6.

With the handle 110 in this upright position, the user can move, lift, or carry the housing 100 by using the handle 110 attached thereto. Provision of the retention flange 123 around the pin 122B prevents disengagement of the detachable attachment mechanism 120 during carriage. Further, positioning the detachable attachment mechanism 120 vertically upward from the center of gravity of the enclosure housing 100 allows the user to lift and carry the housing 100 in a stable horizontal position using the handle 110.

To detach the handle 110 from the housing 100, the user swivels the handle 110 around the pivot axis X approximately 90 degrees away from the upright position until the positioning tab 114 aligns with the second notch 103*b* to establish the second mounting position, as shown in FIG. 4B. In this position, the handle 110 lies horizontally in the L-shaped recess 101 with the engageable pins 122 still retained in the corresponding slots 121 of the sidewalls of the housing 100.

Then, the user slides the handle 110 in the forward longitudinal direction BA along the length of the elongated body 110C from the second sidewall 100B toward the first sidewall 100A of the housing 100 until the positioning tab 114 aligns with the first notch 103*a* to establish the first mounting position, as shown in FIG. 4A. In this position, the handle 110 lies horizontally in the L-shaped recess 101 with the engageable pins 122 completely removed from the corresponding slots 121 of the sidewalls of the housing 100.

With the detachable attachment undone, the user can remove the handle 110 from the housing 100. Removal of the handle 110 does not affect the interior structure of the housing 100, and therefore does not interfere with proper operation of the fixing device 20. The housing 100 thus separated from the handle 110 is ready for installation into the image forming apparatus 200.

Figure 7:
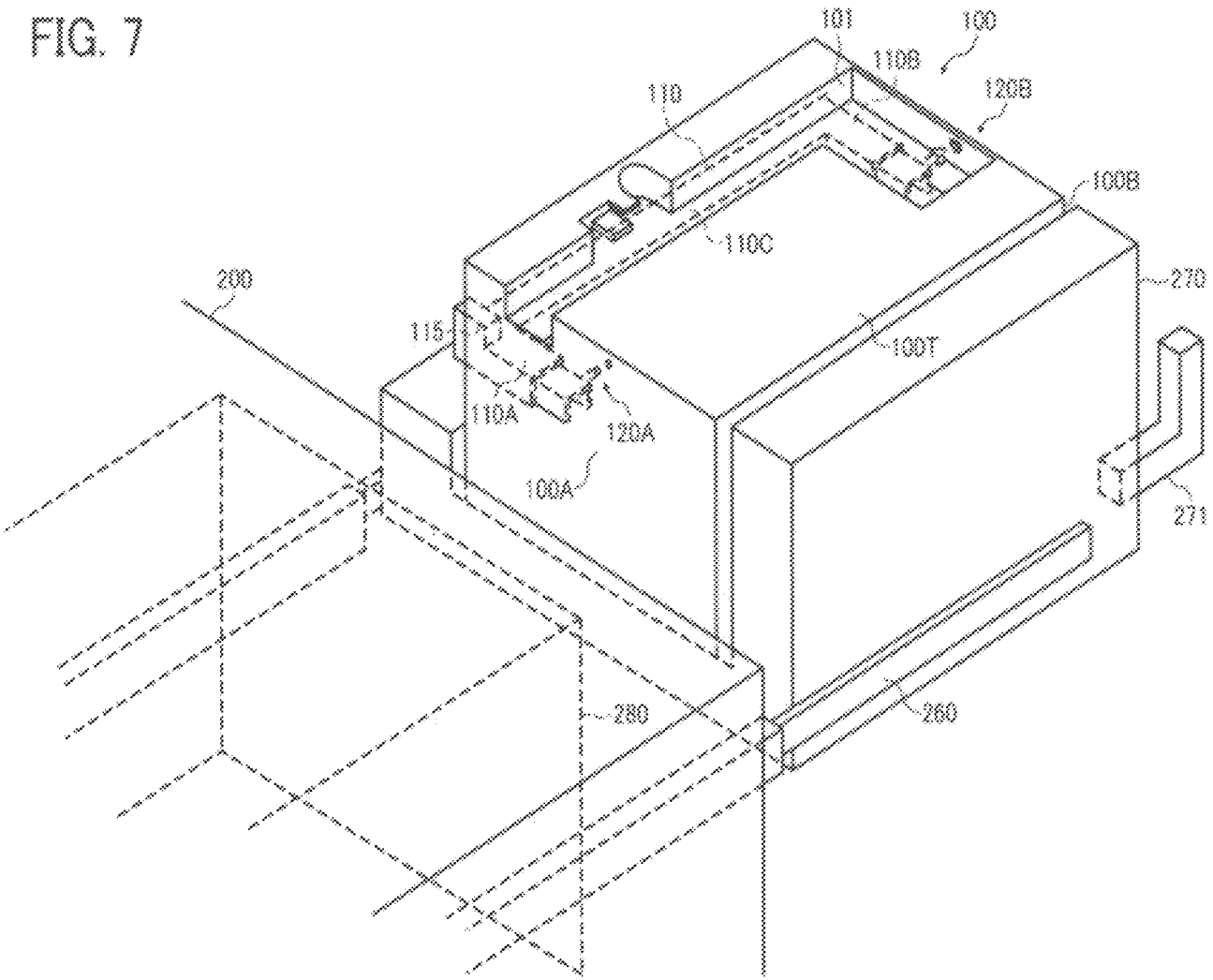
FIG. 7 is a perspective view schematically illustrating the enclosure housing during installation in the image forming apparatus of FIG. 1.

FIG. 7 is a perspective view schematically illustrating the enclosure housing 100 during installation into the image forming apparatus 200.

As shown in FIG. 7, the image forming apparatus 200 includes an extendable guide rail 260 with a mount 270 slidably disposed therealong, on which the enclosure housing 100 is mounted for movement through an opening 280 between an operational position inside the apparatus body and an appropriate position outside the apparatus body. The mount 270 in this embodiment is configured as part of a sheet reversing unit installed adjacent to the fixing device 20 within the image forming apparatus 200. A handle 271 may be provided to the mount 270 to facilitate handling of the mount 270 along the guide rail 260.

To install the housing 100 in the image forming apparatus 200, a user initially extends the guide rail 260 to draw the mount 270 outside the apparatus body. The user then attaches the handle 110 to the housing 100 via the detachable attachment mechanism 120 in the manner described above, lifts or carries the housing 100 by the handle 110, and places the housing 100 onto the mount 270 with the first sidewall 100A facing forward and the second sidewall 100B facing rearward. With the housing 100 properly situated on the mount 270, the user detaches the handle 110 from the housing 100 via the detachable attachment mechanism 120 in the manner described above, and pushes the mount 270 along the guide rail 260 to move the housing 100 inside the apparatus body.

To remove the housing 100 from the image forming apparatus 200, a user extends the guide rail 260 to draw the mount 270 outside the apparatus body. The user then attaches the handle 110 to the housing 100 via the detachable attachment mechanism 120 in the manner described above, lifts the housing 100 by the handle 110, and carries the housing 100 to outside the apparatus body, for example, where he or she can repair or maintain the fixing device 20.

For proper installation of the fixing device 20, the removable handle 110 may be provided with a restraint portion 115 that projects outward from the enclosure housing 100 once the handle 110 is attached to the housing 100, so as to interfere with the frame or opening 280 of the image forming apparatus 200 to prevent the enclosure housing 100 from being improperly installed without removing the removable handle 110.

Specifically, the restraint portion 115 is disposed on the first side arm 110A of the handle 110, protruding upward from the horizontal plane defined by the U-shaped body of the handle 110 accommodated within the recess 101. Where a user tries to install the housing 100 without removing the handle 110 from the housing 100, the restraint portion 115 on the front side interferes with surrounding structure, such as the walls of the apparatus body defining the opening 280, thereby alerting the user to the failure to remove the handle 110, who can then remove the handle 110 to properly install the enclosure housing 100.

Alternatively, instead of interfering with the frame 280 of the image forming apparatus 200, the restraint portion 115 may be configured to interfere with an electrical switch of the image forming apparatus 200 to prevent operation of the same where the enclosure housing 100 is installed without removing the removable handle 100. In such cases, where a user tries to install the housing 100 without removing the handle 110 from the housing 100, the restraint portion 115 contacts the switch to deactivate the image forming apparatus 200, thereby alerting the user to the failure to remove the handle 110, who can then remove the handle 110 to properly install the enclosure housing 100.

Hence, the fixing device 20 according to this patent specification is installed in the image forming apparatus 200 with its removable handle 110 connected to the enclosure housing 100 handled outside the apparatus body, and detached from the enclosure housing 100 accommodated inside the apparatus body. With the handle 110 thus connected as needed and left outside the housing 100 when not in use, the user can handle the fixing assembly without directly touching the enclosure housing 100, which can become significantly hot during operation involving thermal processing of toner with an operating temperature of several tens of degrees Celsius or higher.

The handle 110 after use may be disposed either inside or outside the image forming apparatus 200 as long as the handle 110 does not directly contact the heated surface of the enclosure housing 100. For example, the image forming apparatus may be provided with a storage space or area, such as wall, tray, bin, or compartment, inside or outside the apparatus body, in which the handle 110 may be stored out of contact with the enclosure housing 100 (as indicated by a box C in FIG. 1 for illustration purposes). Such storage space C may be provided adjacent to the fixing device 20 with a sufficient spacing left between the handle 110 and the housing 100.

Provision of the detachably attached handle 110 makes the fixing device 20 readily serviceable for repair or maintenance not only by trained service technicians but also by untrained users, compared to a conventional configuration where the handle is permanently secured to the enclosure housing and accommodated in the image forming apparatus. Such increased user-serviceability of the fixing device 20 results in a shortened downtime, and therefore, an increased productivity of the image forming apparatus 200 incorporating the fixing device 20.

Although in several embodiments depicted above the removable handle 110 is detachably attached to the enclosure housing 100 via a pin-and-slot hinge assembly, alternatively, instead, the detachable attachment mechanism 120 according to this patent specification may be accomplished with any known and future-developed fastener or similar affixing mechanism that can connect two or more objects together temporarily as required during use, and allows for easy separation of the connected objects where such connection is no longer necessary. Such a mechanism is preferably sufficiently durable to withstand loads applied to the handled container, and may or may not include the hinging function depending on the specific configuration of the handle 110 and the housing 100.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device installable in an image forming apparatus, the fixing device comprising:

an enclosure housing to enclose the fixing device;

a removable handle that detachably attaches to the housing to move the housing at least in a direction of handling;

a detachable attachment mechanism to detachably attach the handle to the housing, including a pair of first mutually engageable portions in the housing and a pair of second mutually engageable portions in the handle, wherein one of the pair of first mutually engageable portions and the pair of second mutually engageable portions comprises a slot, and the other of the pair of first mutually engageable portions and the pair of second mutually engageable portions comprises a pin insertable into the slot.

2. The fixing device according to claim 1, wherein the pin extends at least partially in a direction perpendicular to the direction of handling when inserted into the slot, so as to remain in position within the slot as the housing is moved in the direction of handling by the handle.

3. The fixing device according to claim 2, wherein the pin inserted into the slot defines a pivot axis around which the removable handle attached to the enclosure housing is rotatable.

4. The fixing device according to claim 3, further comprising:

a radially asymmetrical retention flange around the pin to prevent disengagement of the detachable attachment mechanism, wherein the retention flange aligns with the slot to allow insertion of the retention flange into the slot where the handle is in a mounting position on the housing, and misaligns with the slot to prevent removable of the flanged pin from the slot where the handle is in an operative position rotated around the pivot axis away from the mounting position.

5. The fixing device according to claim 3, further comprising:

a recess in an exterior of the housing to accommodate the handle, wherein the handle is within the recess where the handle is in a mounting position on the housing, and projects outward from the recess where the handle is in an operative position rotated around the pivot axis away from the mounting position.

6. The fixing device according to claim 5, further comprising:

a positioning tab on the removable handle; and a positioning notch on the enclosure housing, wherein the tab is aligned with the notch as the handle is placed in the recess to attach the handle to the enclosure housing.

7. The fixing device according to claim 1, wherein the detachable attachment mechanism is vertically upward from a center of gravity of the enclosure housing.

8. The fixing device according to claim 1, wherein the removable handle includes a restraint portion that projects beyond the exterior of the enclosure housing in a state in which the removable handle is attached to the enclosure housing, wherein the restraint portion interferes with a frame of the image forming apparatus to prevent the enclosure housing from being installed in the image forming apparatus without first removing the removable handle.

9. The fixing device according to claim 1, wherein the removable handle includes a restraint portion that projects beyond the exterior of the enclosure housing in a state in which the removable handle is attached to the enclosure housing, wherein the restraint portion interferes with an electrical switch of the image forming apparatus to prevent operation of the image forming apparatus where the enclosure housing is installed in the image forming apparatus without first removing the removable handle.

10. The fixing device according to claim 1, wherein the removable handle includes:

a grippable body; and a pair of parallel side arms that each extend perpendicular to the grippable body from opposed longitudinal ends of the grippable body, wherein the removable handle attaches to the enclosure housing with the grippable body extending generally perpendicular to the direction of handling, and the parallel side arms adjoin the housing, the enclosure housing includes the first engageable portions where the housing adjoins each side arm of the handle, and the removable handle includes the second engageable portions at each side arm to engage the first engageable portions.

11. The fixing device according to claim 10, wherein the first engageable portions comprise slots in the housing, and the second engageable portions comprise pins, each at one side arm of the handle for insertion into an adjoining slot, each pin extends at least partially in a direction perpendicular to the direction of handling when inserted into the corresponding slot, so as to remain in position within the slot as the housing is moved in the direction of handling by the handle.

12. The fixing device according to claim 11, wherein the slots in the housing are substantially coaxial with each other, and the pins at the side arms of the handle are substantially coaxial with each other and point in a uniform direction, so that the detachable attachment mechanism is engageable and disengageable by a single longitudinal sliding motion of the handle along the housing.

13. The fixing device according to claim 11, wherein the pins inserted into the respective slots together define a pivot axis around which the removable handle attached to the enclosure housing is rotatable.

14. The fixing device according to claim 13, further comprising:

a radially asymmetrical retention flange around at least one of the pins to prevent disengagement of the detachable attachment mechanism, wherein the retention flange aligns with the slot to allow insertion of the retention flange into the slot where the handle is in a mounting position on the housing, and misaligns with the slot to prevent removal of the retention flange from the slot where the handle is in an operative position rotated around the pivot axis away from the mounting position.

15. The fixing device according to claim 13, further comprising:

a recess in an exterior of the housing to place the handle, wherein the handle is within the recess where the handle is in a mounting position on the housing, and projects outward from the recess where the handle is in an operative position rotated around the pivot axis away from the mounting position.

16. The fixing device according to claim 11, wherein the slots are vertically upward from a center of gravity of the enclosure housing enclosing the fixing device.

17. An image forming apparatus comprising:

a printer to form an image; and a fixing device including an enclosure housing to enclose the fixing device, a removable handle that detachably attaches to the housing to move the housing at least in a direction of handling, and a detachable attachment mechanism to detachably attach the handle to the housing, including a pair of first mutually engageable portions in the housing and a pair of second mutually engageable portions in the handle, wherein one of the pair of first mutually engageable portions and the pair of second mutually engageable portions comprises a slot, and the other of the pair of first mutually engageable portions and the pair of second mutually engageable portions comprises a pin insertable into the slot.

18. The image forming apparatus according to claim 17, further comprising a storage space for storing the removable handle out of contact with the enclosure housing.

19. A method of installing a fixing device in an image forming apparatus, the fixing device including an enclosure housing and a removable handle that detachably attaches to the housing, the method comprising:

enclosing the fixing device in the housing, the housing including a pair of first mutually engageable portions;

attaching the handle to the housing, the handle including a pair of second mutually engageable portions;

mounting the housing onto the image forming apparatus with the attached handle; and detaching the handle from the housing mounted on the image forming apparatus, wherein one of the pair of first mutually engageable portions and the pair of second mutually engageable portions comprises a slot, and the other of the pair of first mutually engageable portions and the pair of second mutually engageable portions comprises a pin insertable into the slot.

* * * * *